US007080450B2

(12) United States Patent
Deming et al.

(10) Patent No.: US 7,080,450 B2
(45) Date of Patent: Jul. 25, 2006

(54) APPARATUS FOR TERMINATING WIRE ASSEMBLIES

(75) Inventors: Neil Edward Deming, Harrisburg, PA (US); Larry Eugene Cox, Jr., Halifax, PA (US)

(73) Assignee: Tyco Electronics Corporation, Middletown, PA (US)

( * ) Notice: Subject to any disclaimer, the term of this patent is extended or adjusted under 35 U.S.C. 154(b) by 323 days.

(21) Appl. No.: 10/389,154

(22) Filed: Mar. 14, 2003

(65) Prior Publication Data

US 2004/0177500 A1 Sep. 16, 2004

(51) Int. Cl.
*H01R 43/00* (2006.01)

(52) U.S. Cl. ..... 29/857; 29/742; 29/748; 29/749; 29/753; 29/760; 29/845; 29/868; 29/884; 29/33 M; 72/155; 72/156; 140/102; 198/465.1; 198/465.3; 269/309

(58) Field of Classification Search ..... 29/857, 29/33 M, 748, 749, 753, 845, 868, 884, 742, 29/760; 72/155, 156; 140/102; 269/309; 198/465.1, 465.3
See application file for complete search history.

(56) References Cited

U.S. PATENT DOCUMENTS

| | | | | |
|---|---|---|---|---|
| 4,375,229 | A * | 3/1983 | Mikami et al. | 140/102 |
| 5,224,251 | A * | 7/1993 | Cameron et al. | 29/33 M |
| 5,655,293 | A * | 8/1997 | Celoudoux et al. | 29/845 |
| 5,933,932 | A * | 8/1999 | Watanabe et al. | 29/33 M |
| 6,427,322 | B1 * | 8/2002 | DeCecca et al. | 29/806 |

* cited by examiner

*Primary Examiner*—A. Dexter Tugbang
*Assistant Examiner*—Tim Phan

(57) ABSTRACT

A machine for terminating wire assemblies comprising: a means for holding a wire assembly; a linear movement means for moving said means for holding between a first area and a second area; an insertion head; and, a means for dislodging; wherein, after a wire assembly is loaded into the means for holding a wire assembly, the means for holding a wire assembly is moved by the linear moving means from the first area to the second area for assembly termination by the insertion head; and, following termination, the assembly is at least partially unseated from the means for holding a wire assembly by the means for dislodging.

14 Claims, 8 Drawing Sheets

APPARATUS FOR TERMINATING WIRE ASSEMBLIES

FIELD OF THE INVENTION

The present invention generally relates to apparatus, methods and articles of manufacture for automatically terminating magnet-wire. More particularly, this invention relates to apparatus, methods and articles of manufacture for automatically terminating magnet-wire in magnet-wire assemblies.

BACKGROUND OF THE INVENTION

Magnet-wire assemblies, used in various electrical applications, such as motors, solenoids and transformers, are comprised of one or more wire assemblies and one or more terminals. The wire assemblies, which may be coil, bobbin or field assemblies, are usually created through winding wire in some desired fashion about a core. The terminals, which may be any of a number of configurations, provide means for connecting the ends of the wire assembly to other components in the electrical application.

Terminals may be attached to the wire assembly using a number of methods, in a process generally known as a "termination process." The termination process might be manual or automated (with the latter category including semiautomated processes.) Whether manual or automated, a termination process typically begins with a wire assembly comprised of a core and wire winding. On the core, and/or other areas on the wire assembly, a terminal attachment area or areas is provided, for affixing the terminal or terminals. For example, a terminal attachment area is often a cavity disposed on a side of the core with the ends of the wire winding extending through the bottom of the core.

If a terminal or terminals is installed within a terminal attachment area and so through the wire end extending through the cavity, an electrical connection is made between the terminal and wire winding. Thus, when the wire assembly is installed in an application, appropriate connections are made to the terminals and the assembly may be energized as desired.

Both wire assemblies and terminals may come in a number of specialized configurations, and so terminal installation may become quite complex. One type of machine that is commonly used in the automated termination process provides a mounting platform, known as a "fixture," for holding wire assemblies while a terminal is installed on the assembly. Each fixture is customized for holding a desired wire assembly configuration, and differently customized fixtures may be used in the same machine.

In these machines, an operator inserts a wire assembly into a fixture in the machine to begin the termination process. The operator then maneuvers the fixture into position for the termination operation. The machine inserts the desired terminal or terminals into the appropriate area or areas on the wire assembly, which, as noted above, is usually a cavity area or areas. The operator then withdraws the fixture from its position, removes the now-terminated wire assembly from the fixture, and inserts a new to-be-terminated wire assembly in the fixture, beginning a new termination process cycle.

The termination process in these machines is slowed by the operator's need to insert each assembly into the fixture, maneuver the fixture with assembly into an appropriate position for the termination operation, withdraw the terminated assembly and fixture from the termination operation position and then withdraw the terminated assembly. Of course, if a fixture needs changing, such as when a different assembly configuration is to be terminated, the operator needs to change the fixture as well, thus adding to downtime.

Some attempts have been made to improve assembly rates of prior art automated termination machines. For example, prior art machines may allow an operator to unload a fixture with a terminated assembly and load a new to-be-terminated assembly while yet another assembly is processing on the machine. Even with such a machine, each assembly still needs to be loaded individually, and so the overall process is still limited by the need for operator intervention for each assembly.

Therefore, it is an object of the present invention to provide apparatus, methods and articles of manufacture for automatically terminating wire assemblies.

It is a further object of the present invention to provide apparatus, methods and articles of manufacture for automatically terminating wire assemblies through use of fixtures that provide for multiple assembly loading and unloading.

It is a further object of the present invention to provide apparatus, methods and articles of manufacture for automatically terminating wire assemblies through use of fixtures that provide for multiple assembly loading and unloading, including automatic fixture ejection.

SUMMARY OF THE INVENTION

The summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown.

The present invention comprises apparatus, methods and articles of manufacture for automatically terminating magnet-wire in magnet-wire assemblies. In the preferred embodiments, a termination machine is provided. A pallet is provided for use in the machine. The pallet has multiple chambers for holding assemblies to be terminated. The pallet is removably mounted to a fixture in the machine. The fixture, in turn, is mounted to a rotary actuator, which in turn is mounted upon a linear actuator for movement to and from an insertion head, where the terminals are inserted in the assemblies and so the assemblies are terminated.

A termination process according to the preferred embodiments begins with the pallet, with to-be-terminated assemblies, being loaded upon the fixture by an operator. The fixture is positioned in a loading/unloading area in the termination machine. The fixture with pallet is then moved along the linear actuator to the termination area. In the termination area the terminals are inserted into the assemblies by the insertion head. The rotary actuator may spin or otherwise rotate the pallet as well in order to accommodate terminal insertion across a number of assemblies.

After the assemblies have been terminated, a two stage dislodging process begins. In the first stage, the now-terminated assemblies are loosened from the pallet. In the second stage the pallet is unseated from the fixture. The fixture with pallet is moved back along the linear actuator to the loading/unloading area, and the pallet is removed from the fixture by the operator. A new pallet with to-be-terminated assemblies may then be loaded upon the fixture and a new termination process can then begin.

Additional objects, advantages and novel features of the invention will be set forth, in part, in the description and figures which follow, and other additional objects will become apparent to those skilled in the art on examination of the following, or may be learned by practice of the invention.

DETAILED DESCRIPTION OF THE PREFERRED EMBODIMENTS

Reference is now made to the accompanying Figures for the purpose of describing, in detail, the preferred embodiments of the present invention. The Figures and accompanying detailed description are provided as examples and are not intended to limit the scope of the claims appended hereto.

Figure 1:
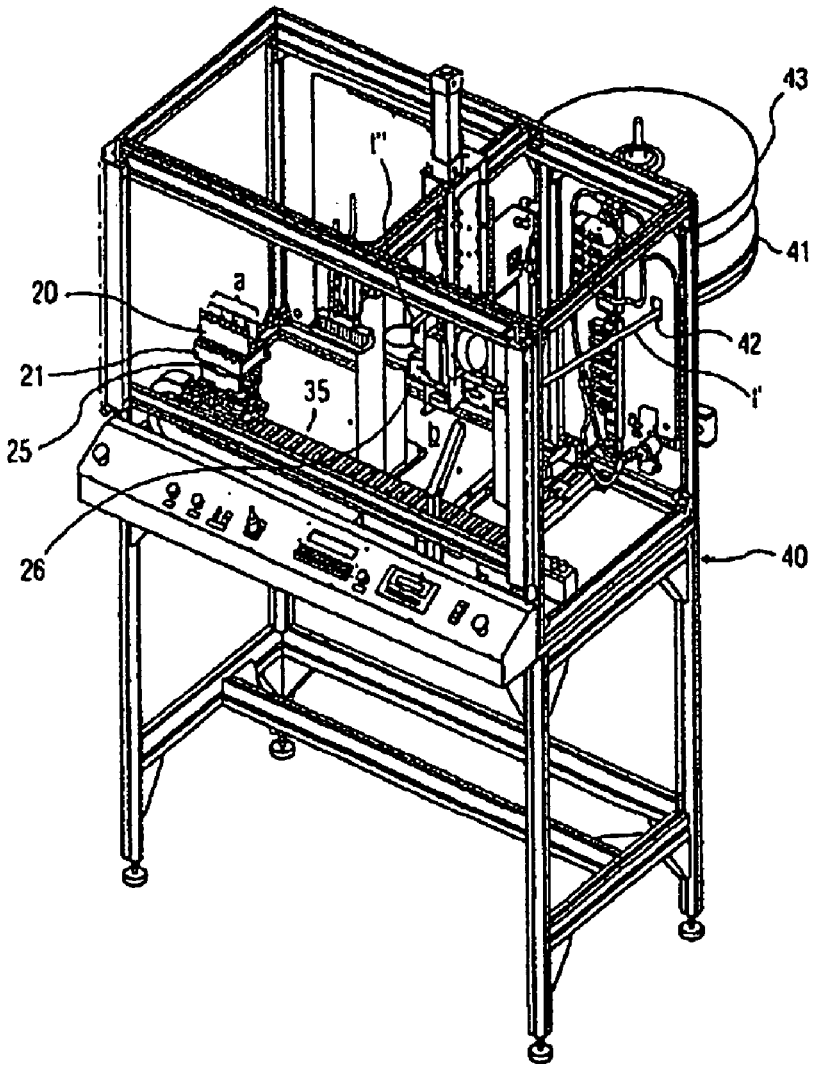
FIG. 1 is a view of a preferred embodiment.

FIG. 1 shows a preferred embodiment. Termination machine 40 has transparent panels on the two sides for operator viewing, and a light curtain in the front of the machine. Fixture 21, mounted on rotary actuator 25, is shown in loading/unloading area a, that is, where the operator has loaded the fixture with pallet 20. Pallet 20 holds four assemblies for termination, which are friction fit in the pallet. The assemblies should be fit tightly within the pallet so they do not shift as they are terminated. In other embodiments, other methods besides friction fit may be used to accommodate the assemblies within the pallet, such as a pneumatically operated clamping device, as long as the assemblies are sufficiently retained so as to withstand forces imposed by the termination operation.

The fixture and pallet will then be moved to termination area b along linear actuator 35 (see FIG. 2) where terminals are inserted into the assemblies on pallet 20 by insertion head 26 (a process also known as termination of the assemblies.) The assemblies are then dislodged from the pallet and the pallet is dislodged from the fixture. The pallet and fixture then return to loading/unloading area a, where the pallet with the terminated assemblies is unloaded. A new pallet with assemblies to be terminated may then be loaded on the fixture for the start of another termination cycle.

It should be noted that in this embodiment and all preferred embodiments, a pallet comprises a variable number of chambers for receiving assemblies to be processed. For example, in this embodiment, as will be further described below, four chambers are available on the pallet to receive assemblies. Other embodiments may have less than four or more than four. For example, a pallet may only hold one very large assembly. Moreover, in operation, not all available chambers need to be filled with assemblies during any particular termination process.

It should also be noted that the chambers of any particular pallet may be customized for the assemblies to be terminated. So for example, customized pallet embodiments may be configured for retaining various types of assemblies as desired.

Returning now to FIG. 1, feed reels 41 and 43 hold terminals, in the form of strips t' and t", to be installed upon the assemblies. The strips unreel from the feed reels 41 and 43 and into the machine by way of recesses against the back wall. Recess 42 provides entry for the terminals on strip t', and a similar recess (not shown) provides entry for the terminals on strip t". The terminals on strips t' and t" are then installed on the assemblies through insertion head 26 in termination area b.

The fixture moves from loading/unloading area a to termination area b and back on linear screw actuator 35. In the especially preferred embodiment, a linear screw actuator from Tol-O-Matic, Inc. is used, Part No. TBD-M3S-SNO 1 SPL. A stepper motor (not shown) and driver drives the screw, with a control system in place to control the stepper motor, which in the especially preferred embodiment is a motor and driver from Pacific Scientific appropriate to drive the actuator. The control system is as known in the art. In other embodiments, other methods may be used to control the screw, such as for example, a servomotor, which may be desired for greater speed and/or precision. Additionally, other linear movement means as known in the art may be used in yet other embodiments.

Figure 2:
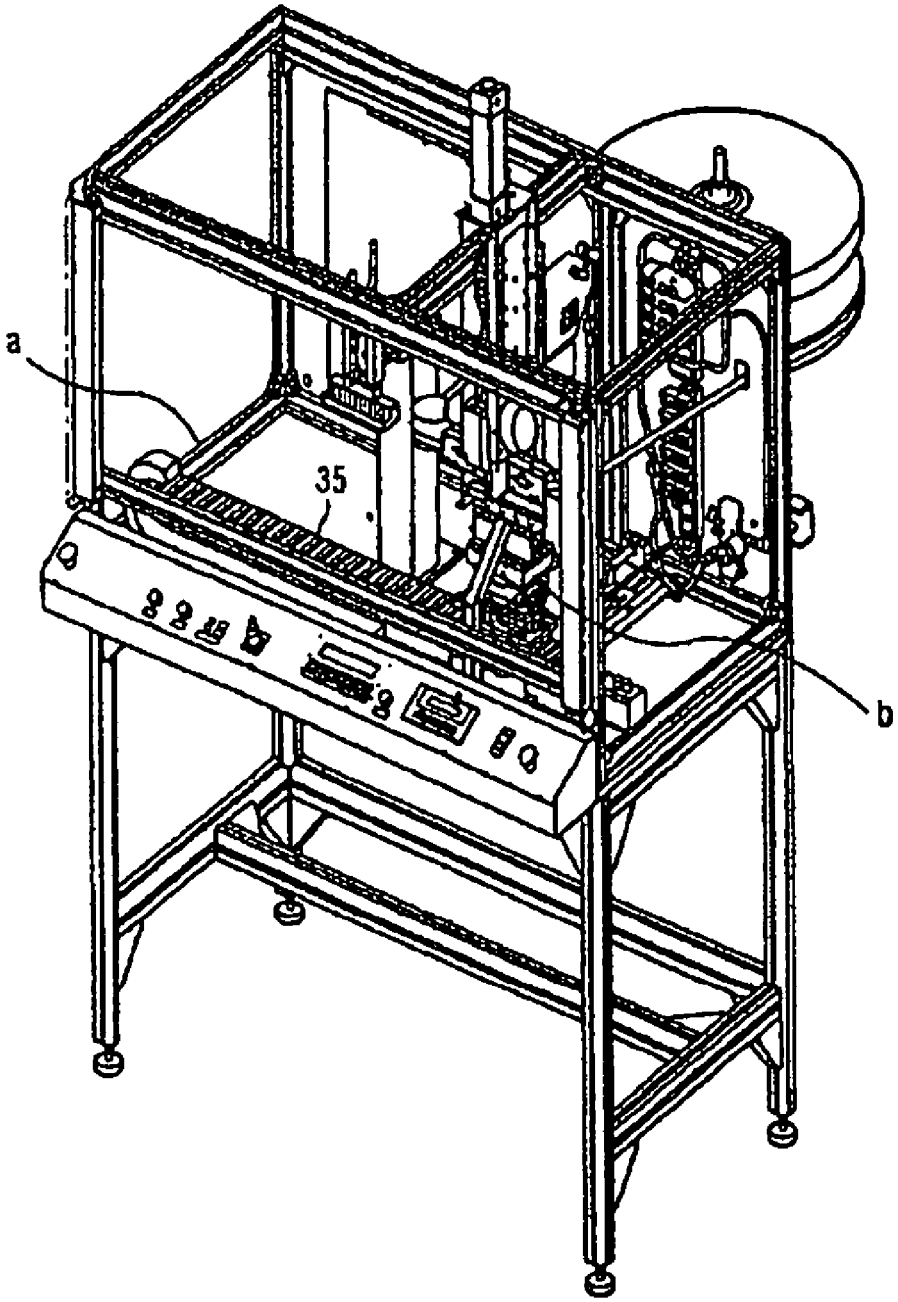
FIG. 2 is another view of the embodiment of FIG. 1.

FIG. 2 shows the preferred embodiment of FIG. 1 with fixture 21 moved, via linear screw actuator 35 to termination area b.

Figure 3:
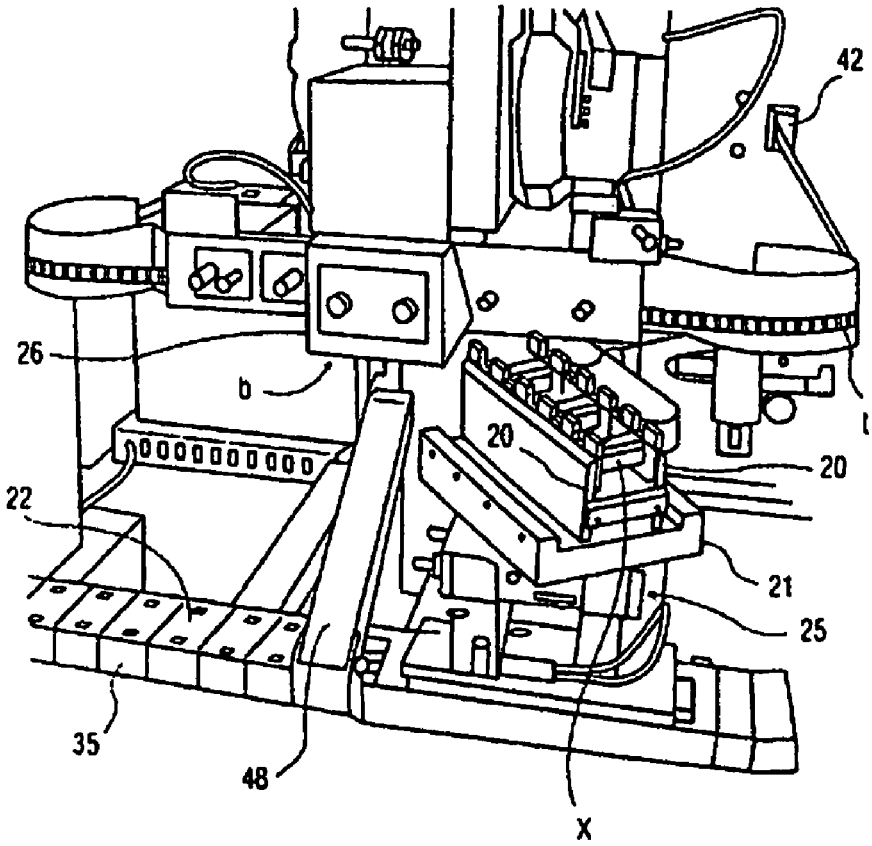
FIG. 3 is another view of the embodiment of FIG. 1.

FIG. 3 shows the preferred embodiment of FIG. 2 with pallet 20 on fixture 21 brought to a rotation area slightly beyond termination area b, by actuator 35, in order to rotate the fixture via rotary actuator 25. A rotary movement means such as rotary actuator 25 helps provide flexibility in installing terminals on the assemblies (such as assemblies x shown in the drawing) as insertion head 26 can then more easily access various areas throughout the assembly for terminal installation. Flexible carrier 22 holds pneumatic hoses and cables for rotary actuator 25 operation. Scrap removal chute 48 is used to collect any excess wire and other components removed as a result of the termination process.

The especially preferred embodiments use a rotary actuator from Robohand, Inc., Model RR-36M-180-M, although other means to provide rotary motion to the fixture may be used in other embodiments. Of course, only partial rotary motion, or no rotary motion, may be desired. Additionally, the rotary actuator and fixture may be provided as one unit in various other embodiments. Additionally, the especially preferred embodiments use an MPT-5 insertion module from Tyco Electronics Corporation as an insertion head. By use of the MPT-5, assemblies to be terminated can have cavities in either a linear pattern, axial pattern or a combination of both. Of course, other embodiments may use other termination heads as known in the art.

It should be noted that in other embodiments, a first area may comprise separate loading and unloading areas as desired. Additionally, a second area may comprise a termination area, rotation area and/or dislodging area, or any combination thereof as desired.

Before turning to a further description of the terminal installation process of the preferred embodiments, it might be helpful to review the pallet, fixture, and rotary actuator of the preferred embodiment.

Figure 4:
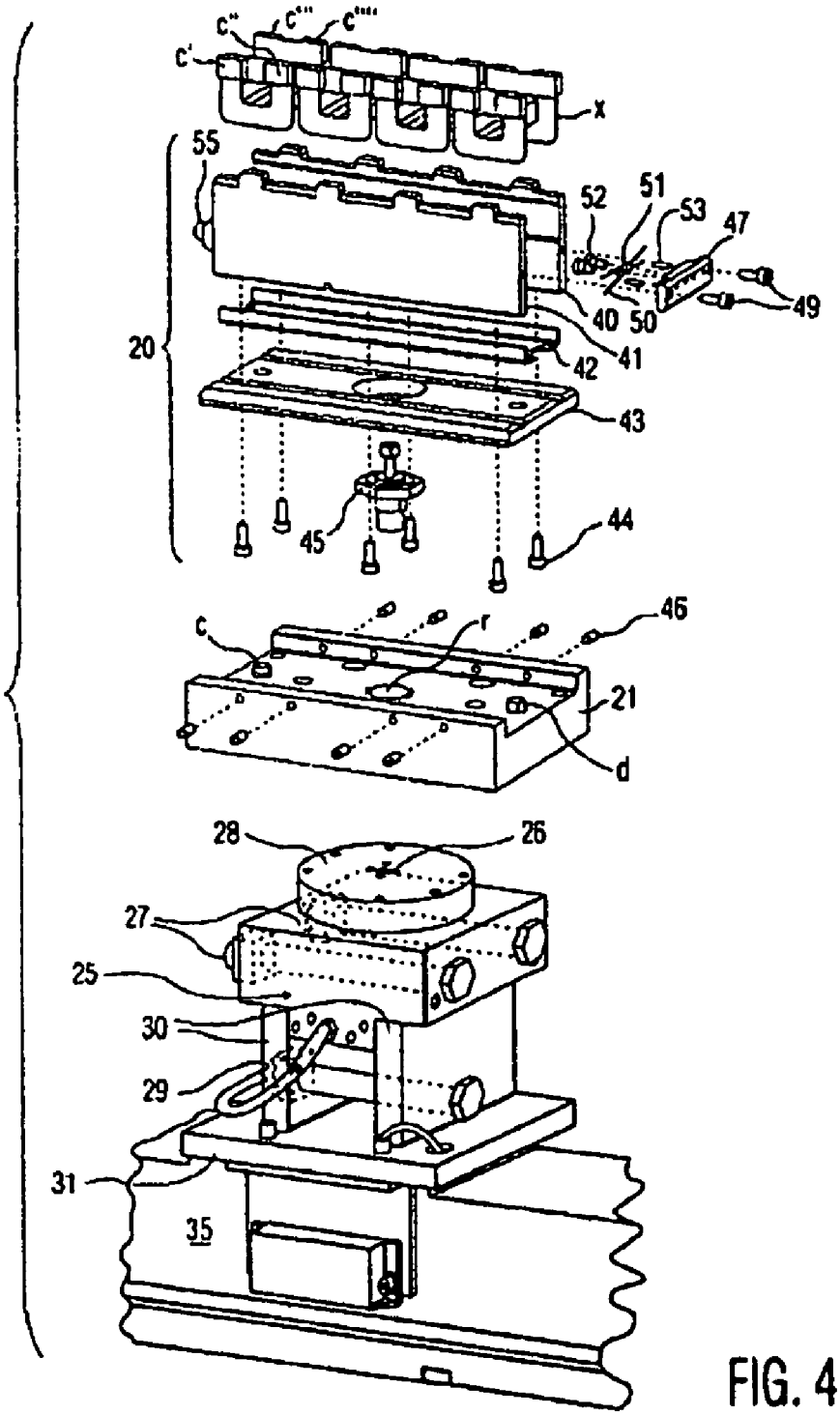
FIG. 4 is a view of a preferred embodiment.

FIG. 4 shows a view of the pallet, fixture, and rotary actuator of the preferred embodiment. Assemblies x of types as known in the art, e.g. coil, bobbin or field assemblies, are shown above the pallet (shown generally at 20) with termination cavities c' through c"" shown on an assembly as well. In these assemblies, terminals will be inserted into the desired cavity or cavities. Of course, other assemblies may have terminal attachment areas or cavities in other areas, and be terminated by various embodiments of the present invention accordingly.

Generally, assemblies are loaded into the pallet from the top of the pallet, and pushed downward, as there is some frictional resistance from the pallet rails, until the bottom edge or edges of the assembly (depending upon assembly shape) encounters the top edge of assembly ejector plate 42, as is described in further detail below.

Pallet 20 comprises first and second pallet rails 40 and 41, assembly ejector plate 42, and pallet base assembly 43. The pallet rails are fixed by pallet screws, as for example, screw 44 in ridges of pallet base assembly 43. Pallet retaining plate 47 is fixed by screws 49 to the pallet rails. Torsion springs 50 and 51 are fixed to pallet retaining plate 47 by screws 52. Dowel pin stops 53 are also fixed to pallet retaining plate 47.

Figure 5:
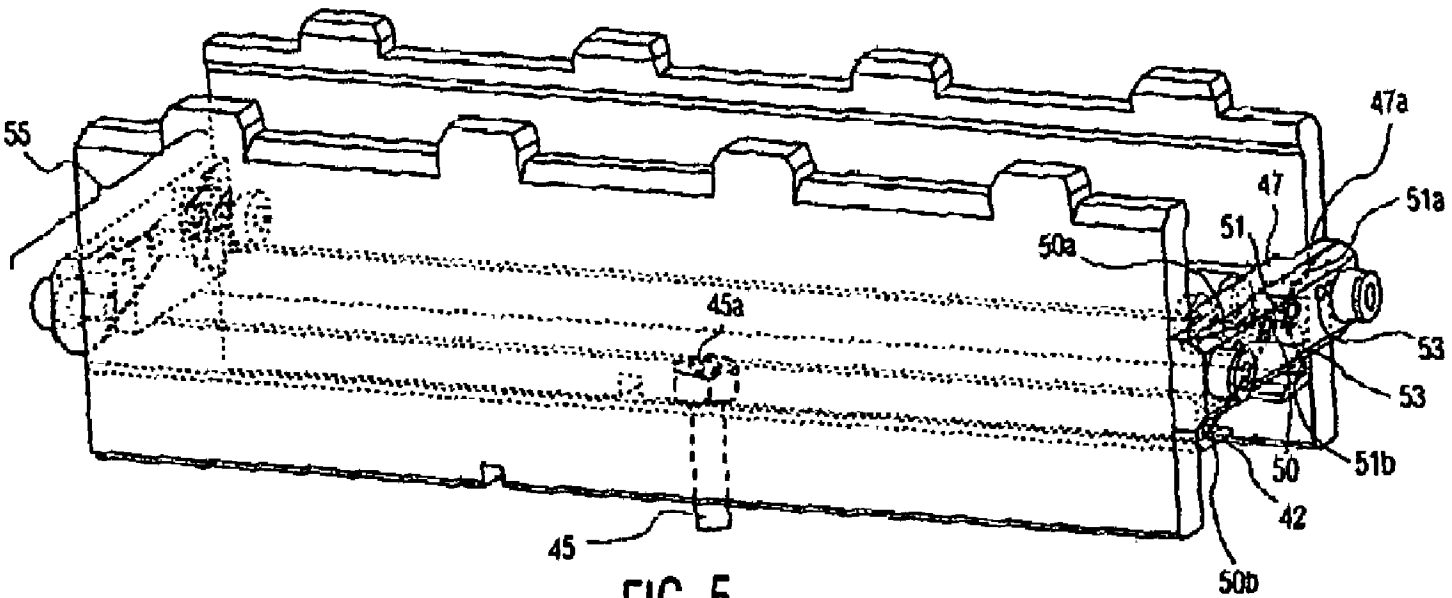
FIG. 5 is another view of the embodiment of FIG. 4.

Moving briefly to FIG. 5, the upper legs 50*a* and 51*a* respectively of torsion springs 50 and 51 are retained within a recess on pallet retaining plate 47. The lower legs 50*b* and 51*b* respectively of torsion springs 50 and 51 contact the inner edges of assembly ejector plate 42. Thus the springs provide resistance against the upward movement of the assembly ejector plate 42, which is moved via pneumatic cylinder 45, so that when assemblies are loaded into the pallet from the top of the pallet, the assemblies do not have to force assembly ejector plate 42 downward. A similar arrangement of pallet retaining plate, torsion springs, screws and dowels is present on the opposite ends of the pallet rails as shown by the partially seen assembly 55. The entire pallet assembly is constructed of steel, although other materials as known in the art may be used.

Returning to FIG. 4, pallet 20 is retained upon fixture 21 through ball detents, such as shown by ball detent 46, which are inserted within respective recesses in fixture 21 and so protrude slightly from the inner walls of fixture 21. Thus the ball detents permit the edges of a pallet to be pushed into place over the detents and onto fixture 21. It should be noted that in alternative embodiments, alternative means, such as springs or mechanical fingers may be used for loading and/or retaining a pallet upon a fixture. It also should be noted that, in other embodiments, it may be desired to eliminate the fixture and load a pallet directly upon an appropriately configured flange on a rotary actuator or other retention platform.

Fixture 21 also provides a recess r for pneumatic cylinder 45. Pneumatic cylinder 45, as will be described in further detail below, assists in dislodging the assemblies and pallet. Pins c and d on fixture 21 insert into recesses on pallet base assembly 43 and so locate the pallet when loaded upon fixture 21.

It should be noted that, in certain embodiments, it may be desired to utilize locating pins that are directional as well, that is, utilize locational pins that are uniquely shaped so as to provide appropriate guidance into uniquely shaped corresponding recesses on the pallet base assembly. Thus, in these embodiments, if the base assembly is attempted to be fitted in reverse, the studs would not engage with the opposite recess.

Fixture 21 is itself mounted on flange 28 of rotary actuator 25, through the use of screws not shown here. Flange 28 may rotate as a termination process proceeds (see, e.g., FIG. 3) and so any installed fixture, such as fixture 21, and, in turn pallet 20, may rotate as well.

Ports 26 provide the connections for pneumatic cylinder 45. Additionally flow controls 27 and 29 are shown, for the rotary drivers within the actuator and for the pneumatic cylinder 45. Legs 30 retain actuator 25 on base 31 on linear actuator 35. Not shown are various feed lines for the pneumatics.

A rotary actuator, such as is used in the preferred embodiments, provides sufficient speed, accuracy and strength (to resist the downward force supplied by the termination head.) Other embodiments may use other mechanisms as known in the art to provide any desired rotation. Additionally, yet other embodiments may not use a rotary movement means at all, and have a pallet, and/or pallet-fixture combination, or other means as known in the art for holding a wire assembly installed upon a retention platform on a linear movement means.

As described above, with regard to this embodiment, once the assemblies are terminated, or otherwise as desired, the assemblies and pallet 20 are dislodged from the fixture 21 in a two stage process. (It should be noted that other embodiments may use a one stage process in dislodging a pallet and assembl(ies) from a fixture or other retention platform.) The first stage at least partially loosens the assemblies within the pallet, which eases subsequent removal of the assemblies from the pallet and subsequent reuse of the pallet. The second stage unseats the pallet from the ball detents of the fixture, where it may be removed as desired. In the especially preferred embodiments, this dislodging occurs in a dislodging area, away from the termination area but before the rotary actuator, fixture and pallet reach the loading/unloading area. The rotary actuator, fixture and pallet stop along the linear actuator, the dislodging process occurs, and then the rotary actuator, fixture and pallet proceed to the loading/unloading area where the unseated pallet with loosened assemblies is removed. In the especially preferred embodiments, the light curtain shuts down when the rotary actuator, fixture and pallet reach the loading/unloading area and so the operator can reach into the machine for pallet and assembly removal. (Otherwise of course, any breach of the light curtain by the operator would shut the machine down.) As was described above, in yet other embodiments, a second area may be expansive enough to include a dislodging area.

Figure 6:
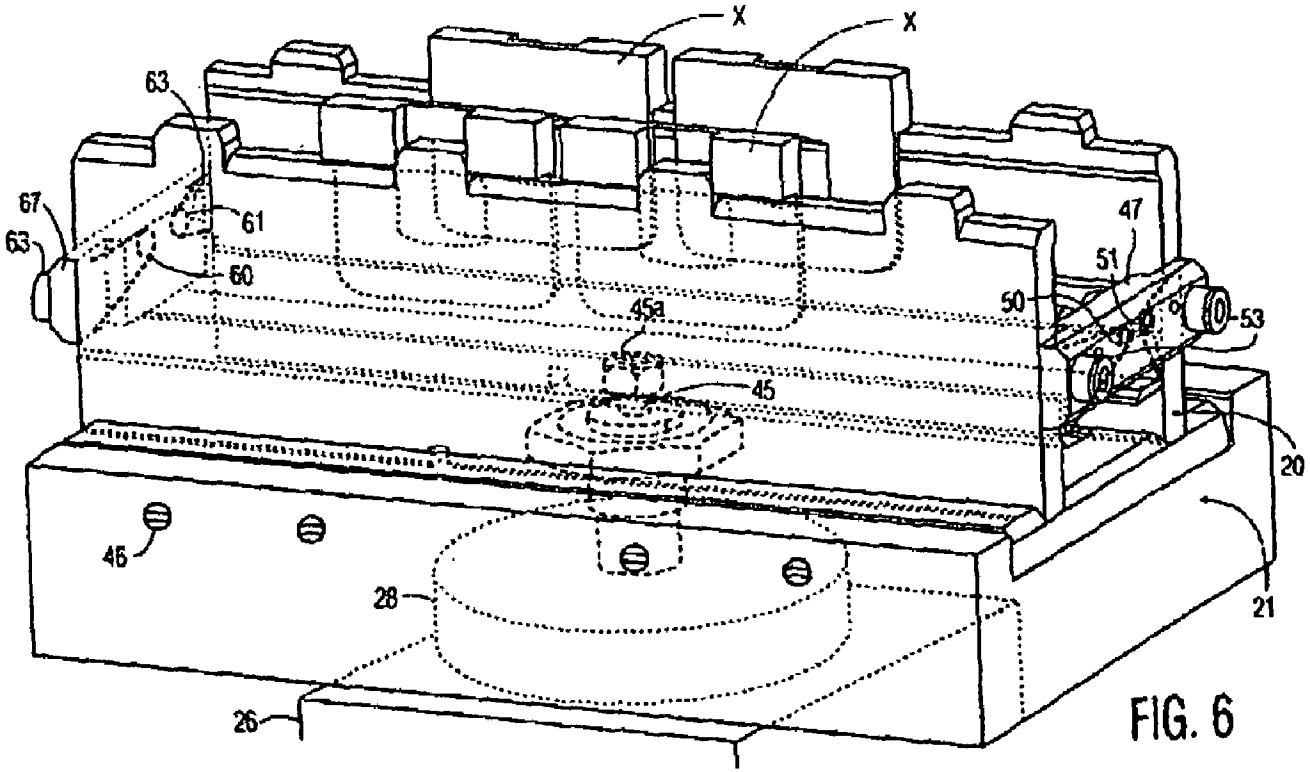
FIG. 6 is a partial schematic view of the embodiment of FIG. 4.

Turning to FIG. 6, a partial schematic view of the preferred embodiment is seen. Pallet 20 is loaded on fixture 21 and held by ball detents, such as for example ball detent 46. Fixture 21 is mounted in turn on flange 28 of rotary actuator 26. Only two assemblies x are shown loaded into the pallet for ease of review of the figure.

Torsion springs 50 and 51 and 60 and 61 are shown on either side of pallet 20, behind pallet retaining plates 47 and 67 respectively. Dowel stop pins 53 and 63 are also shown. Pneumatic cylinder 45 is at rest.

Figure 7:
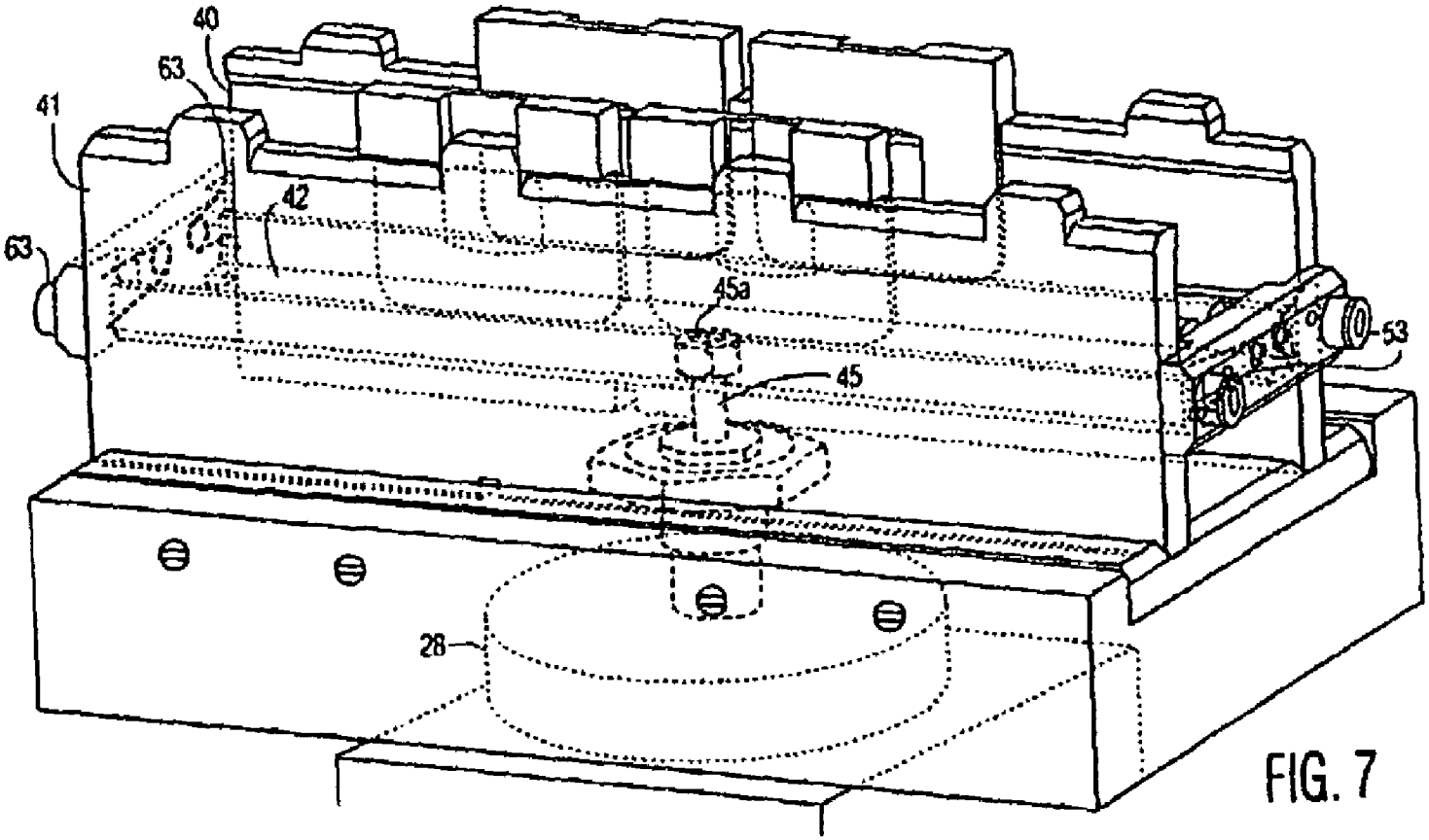
FIG. 7 is another partial schematic view of the embodiment of FIG. 4.

FIG. 7 shows the first dislodging stage of the preferred embodiments, where the assemblies are loosened. The stage begins when piston 45*a* of pneumatic cylinder 45 pushes assembly ejector plate 42 a sufficient distance upwardly, through pallet rails 40 and 41, until assembly ejector plate 42 contacts dowel pin stops 53 and 63 and so stops moving. The embodiment then proceeds to the second dislodging stage shown in FIG. 8. The second dislodging stage unseats the pallet from the fixture.

Figure 8:
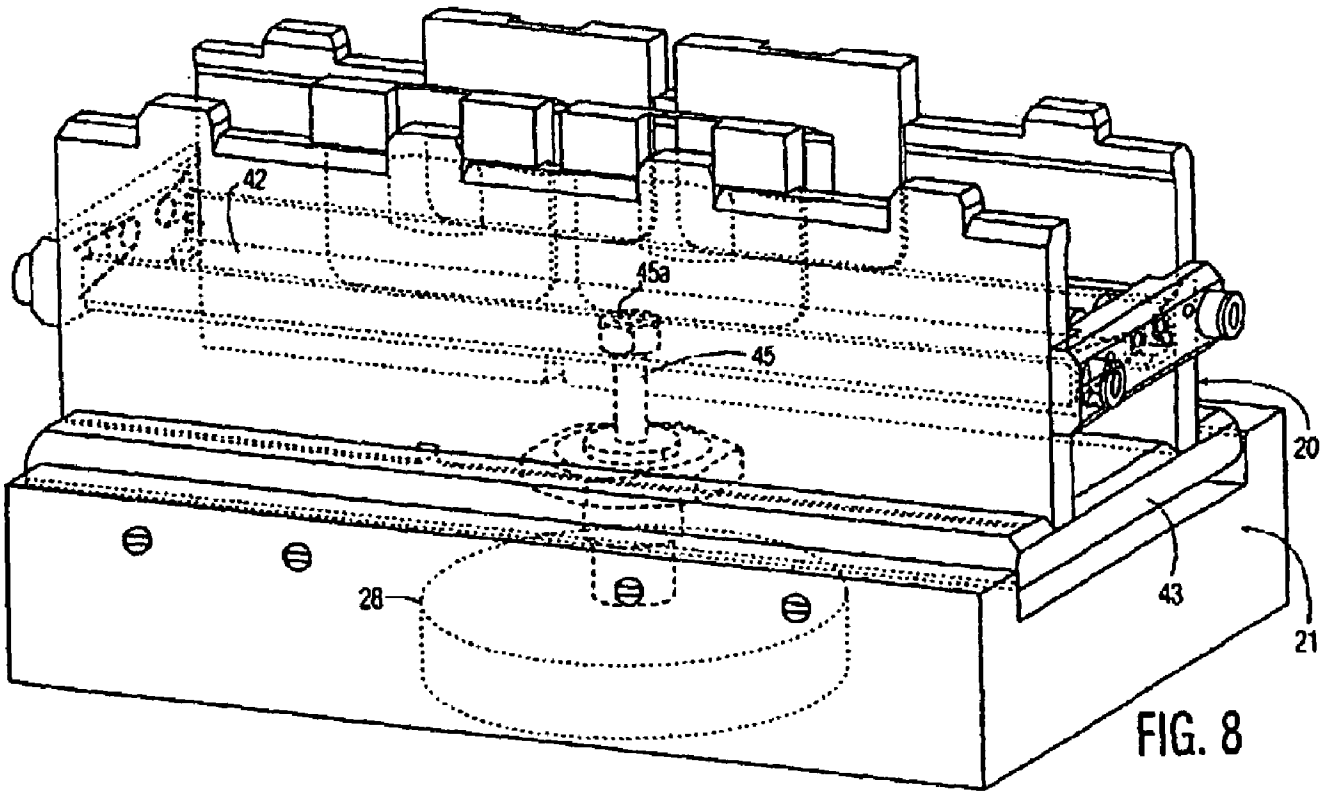
FIG. 8 is another partial schematic view of the embodiment of FIG. 4.

Turning now to FIG. 8, the piston 45*a* of pneumatic cylinder 45 continues to extend upwardly. Since piston 45*a* can no longer move assembly ejector plate 42 independently of the pallet rails—assembly ejector plate 42 has struck the dowel stop pins of the pallet rails—piston 45*a* now proceeds to drive assembly ejector plate 42, as well as the remainder of the pallet, including pallet base assembly 43, out of the ball detents, thereby unseating the pallet from the fixture.

The pallet is still sufficiently retained within the fixture so as to be able to travel back along the linear actuator to the loading/unloading area. Once it arrives, the light curtain shuts down and the operator can then reach inside the machine, remove the pallet and remove the assemblies from the pallet.

Once the pallet with terminated assemblies has been removed, the operator may load a new pallet with assemblies to be terminated. These are usually loaded into a new pallet while a pallet is being terminated. The operator places the pallet with the assemblies to be terminated on the fixture and pins c and d (shown in FIG. 4) engage their mating recesses. The operator presses the pallet down onto the fixture so as to engage the pallet base assembly edges over the ball detents. Once the fixture snaps in place, the operator starts the machine up, the light curtain is again turned on, and the termination process begins again.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

We claim:

1. A machine for terminating wire assemblies comprising:

a pallet configured to hold a wire assembly, wherein said pallet comprises pallet rails and a pallet base, said pallet rails and said pallet base defining a chamber, the wire assembly being received within said chamber, wherein said pallet further comprises an ejector plate received within said chamber;

an actuator, coupled to said pallet, moving said pallet between a first position and a second position, wherein, after the wire assembly is loaded into said pallet, said pallet is moved by said actuator from said first position to said second position for termination of a wire to the wire assembly; and a dislodging member coupled to said pallet and movable with respect to said pallet, wherein, after the termination of the wire to the wire assembly, said dislodging member is moved with respect to said pallet to at least partially dislodge the wire assembly from the pallet, said dislodging member being coupled to said ejector plate, wherein, when said dislodging member is moved with respect to said pallet, said ejector plate is moved within said chamber and engages the wire assembly and dislodges the wire assembly from the pallet.

2. A machine as in claim 1, wherein said actuator is one of a rotary actuator and a linear actuator.

3. A machine as in claim 1, further comprising an insertion head, wherein said pallet is aligned with said insertion head when in said second position, said insertion head is configured to terminate a wire to the wire assembly when said pallet is in said second position.

4. A machine as in claim 1, wherein said dislodging member comprises a pneumatic cylinder movable in a linear direction.

5. A machine as in claim 1, wherein said pallet further comprises:

a retaining plate extending between said pallet rails;

an ejector plate received within said chamber and moveable within said chamber; and a torsion spring extending between said retaining plate and said ejector plate, said torsion spring configured to provide resistance against movement of said ejector plate in a direction toward the wire assembly.

6. A machine for terminating wire assemblies comprising:

a pallet configured to hold a wire assembly, wherein said pallet comprises pallet rails and a pallet base, said pallet rails and said pallet base defining a chamber, the wire assembly being received within said chamber;

an actuator, coupled to said pallet, moving said pallet between a first position and a second position, wherein, after the wire assembly is loaded into said pallet, said pallet is moved by said actuator from said first position to said second position for termination of a wire to the wire assembly; and a dislodging member coupled to said pallet and movable with respect to said pallet, wherein, after the termination of the wire to the wire assembly, said dislodging member is moved with respect to said pallet to at least partially dislodge the wire assembly from the pallet, wherein said pallet further comprises an ejector plate received within said chamber and extending parallel to said pallet base, said ejector plate moveable within said chamber in a direction substantially perpendicular to said pallet base.

7. A machine for terminating wire assemblies comprising:

a fixture;

a pallet configured to hold a wire assembly and removably mounted to said fixture, wherein said pallet comprises pallet rails and a pallet base said pallet base is removably coupled to said fixture, said pallet rails and said pallet base defining a chamber, the wire assembly is received within said chamber, wherein said pallet further comprises an ejector plate received within said chamber;

an actuator for moving said fixture between a first position and a second position; and a dislodging member positioned proximate to said pallet, wherein said dislodging member is moved with respect to said pallet to at least partially dislodge the wire assembly from the pallet and to at least partially dislodge said pallet from said fixture, said dislodging member being coupled to said ejector plate, wherein, when said dislodging member is moved with respect to said pallet, said ejector plate is moved within said chamber and engages the wire assembly and dislodges the wire assembly from the pallet.

8. A machine as in claim 7, wherein said actuator is one of a rotary actuator and a linear actuator.

9. A machine as in claim 7, further comprising an insertion head, wherein said pallet is aligned with said insertion head when in said second position, said insertion head is configured to terminate a wire to the wire assembly when said pallet is in said second position.

10. A machine as in claim 7, wherein said dislodging member comprises a pneumatic cylinder movable in a linear direction.

11. A machine as in claim 7, wherein said ejector plate extends parallel to said pallet base, said ejector plate being moveable within said chamber in a direction substantially perpendicular to said pallet base.

12. A machine as in claim 7, wherein said pallet further comprises:

a retaining plate extending between said pallet rails;

an ejector plate received within said chamber and moveable within said chamber; and a torsion spring extending between said retaining plate and said ejector plate, said torsion spring configured to provide resistance against movement of said ejector plate in a direction toward the wire assembly.

13. A machine as in claim 7, wherein said pallet further comprises:

a retaining plate extending between said pallet rails, wherein said dislodging member is configured to move said ejector plate within said chamber until said ejector plate engages said retaining plate.

14. A machine as in claim 13, wherein, when said ejector plate is moved by said dislodging member, said ejector plate dislodges the wire assembly prior to engaging said retaining plate, and said ejector plate dislodges said pallet after engaging said retaining plate.

* * * * *